US007811354B2

(12) United States Patent
Leidel et al.

(10) Patent No.: US 7,811,354 B2
(45) Date of Patent: Oct. 12, 2010

(54) HIGH PERFORMANCE POWDERED METAL MIXTURES FOR SHAPED CHARGE LINERS

(75) Inventors: David J. Leidel, Arlington, TX (US); James Phillip Lawson, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/475,542

(22) Filed: May 31, 2009

(65) Prior Publication Data

US 2010/0154670 A1 Jun. 24, 2010

Related U.S. Application Data

(63) Continuation of application No. 10/080,785, filed on Feb. 22, 2002, now Pat. No. 7,547,345, which is a continuation of application No. 09/499,174, filed on Feb. 7, 2000, now abandoned.

(51) Int. Cl.
*C21C 5/44* (2006.01)

(52) U.S. Cl. ..... 75/246; 102/306; 102/307; 102/476

(58) Field of Classification Search ..... 75/246; 102/306, 307, 476
See application file for complete search history.

(56) References Cited

U.S. PATENT DOCUMENTS

| | | | |
|---|---|---|---|
| 3,888,636 | A | 6/1975 | Sczerzenie et al. |
| 3,979,234 | A | 9/1976 | Northcutt et al. |
| 4,498,395 | A | 2/1985 | Kock et al. |
| 4,613,370 | A | 9/1986 | Held et al. |
| 4,794,990 | A | 1/1989 | Riggs |
| 4,938,799 | A | 7/1990 | Nicolas |
| 5,069,869 | A | 12/1991 | Nicolas et al. |
| 5,098,487 | A | 3/1992 | Branuer et al. |
| 5,221,808 | A | 6/1993 | Werner et al. |
| 5,279,228 | A | 1/1994 | Ayer |
| 5,522,319 | A | 6/1996 | Haselman, Jr. |
| 5,567,906 | A | 10/1996 | Reese et al. |
| 5,656,791 | A | 8/1997 | Reese et al. |
| 5,814,758 | A | 9/1998 | Leidel |

(Continued)

FOREIGN PATENT DOCUMENTS

| | | |
|---|---|---|
| EP | 0694754 | 1/1996 |

(Continued)

OTHER PUBLICATIONS

Claus G. Goetzel, Ph.D.; "Treatise on Powder Metallurgy, vol. 1"; pp. 251-257; 1949.

(Continued)

*Primary Examiner*—George Wyszomierski
*Assistant Examiner*—Tima M McGuthry-Banks
(74) *Attorney, Agent, or Firm*—Lawrence R. Youst

(57) ABSTRACT

A liner (18) for a shaped charge (10) that utilizes a high performance powered metal mixture to achieve improved penetration depths during the perforation of a wellbore is disclosed. The high performance powdered metal mixture includes powdered tungsten and powdered metal binder. The powered metal binder may be selected from the group consisting of tantalum, molybdenum, lead, cooper and combination thereof. This mixture is compressively formed into a substantially conically shaped liner (18).

32 Claims, 1 Drawing Sheet

U.S. PATENT DOCUMENTS

| | | | | |
|---|---|---|---|---|
| 5,912,399 | A | 6/1999 | Yu et al. | |
| 6,012,392 | A | 1/2000 | Norman et al. | |
| 6,152,040 | A | 11/2000 | Riley et al. | |
| 6,158,351 | A | 12/2000 | Mravic et al. | |
| 6,250,229 | B1 | 6/2001 | Kerdraon et al. | |
| 6,296,044 | B1 | 10/2001 | Brooks et al. | |
| 6,354,219 | B1 | 3/2002 | Pratt et al. | |
| 6,530,326 | B1 | 3/2003 | Wendt, Jr. et al. | |
| 6,564,718 | B2 | 5/2003 | Reese et al. | |
| 6,634,300 | B2 | 10/2003 | Reese et al. | |
| 7,011,027 | B2 | 3/2006 | Reese et al. | |
| 7,547,345 | B2 * | 6/2009 | Leidel et al. | 75/246 |

FOREIGN PATENT DOCUMENTS

| | | |
|---|---|---|
| FR | 2530800 | 1/1984 |
| WO | 9220481 | 11/1992 |
| WO | 0190677 | 11/2001 |
| WO | 0190678 | 11/2001 |
| WO | 0192674 | 12/2001 |
| WO | 0196807 | 12/2001 |

OTHER PUBLICATIONS

A. Lichtenberg; "Influence of the Elaboration of W-Alloys Liners on the Behavior of Shaped Charge Jets"; pp. 66-73; 1997.

Declaration of David J. Liedel, Ph.D; Feb. 21, 2008.

Halliburton's Substantive Motion 6; Before the Board of Patent Appeals and Interferences; Feb. 21, 2008.

* cited by examiner

HIGH PERFORMANCE POWDERED METAL MIXTURES FOR SHAPED CHARGE LINERS

CROSS REFERENCE TO RELATED APPLICATION

This is a continuation of application Ser. No. 10/080,785 filed on Feb. 22, 2002, now U.S. Pat. No. 7,547,345, which is a continuation of application Ser. No. 09/499,174 filed on Feb. 7, 2000, now abandoned.

TECHNICAL FIELD OF THE INVENTION

The present invention relates in general to explosive shaped charges and, in particular to, high performance powdered metal mixtures for use as the liner in a shaped charge, particularly a shaped charge used for oil well perforating.

BACKGROUND OF THE INVENTION

Without limiting the scope of the invention, its background is described in connection with perforating oil wells to allow for hydrocarbon production, as an example. Shaped charges are typically used to make hydraulic communication passages, called perforations, in a wellbore drilled into the earth. The perforations are needed as casing is typically cemented in place with the wellbore. The cemented casing hydraulically isolates the various formations penetrated by the wellbore.

Shaped charges typically include a housing, a quantity of high explosive and a liner. The liner has a generally conical shape and is formed by compressing powdered metal. The major constituent of the powdered metal was typically copper. The powdered copper was typically mixed with a fractional amount of lead, for example twenty percent by weight, and trace amount of graphite as a lubricant and oil to reduce oxidation.

In operation, the perforation is made by detonating the high explosive which causes the liner to collapse. The collapsed liner or jet is ejected from the shaped charge at very high velocity. The jet is able to penetrate the casing, the cement and the formation, thereby forming a perforation.

The penetration depth of the perforation into the formation is highly dependent upon the design of the shaped charge. For example, the penetration depth may be increased by increasing the quantity of high explosive which is detonated to propel the jet. It has been found, however, that increasing the quantity of explosive not only increase penetration depth but may also increase the amount of collateral damage to the wellbore and to equipment used to transport the shaped charge to depth.

Attempts have been made to design a liner using a powdered metal having a higher density than copper. For example, attempts have been made to design a liner using a mixture of powdered tungsten, powdered copper and powdered lead. This mixture yields a higher penetration depth than typical copper-lead liners. Typical percentages of such a mixture might be 55% tungsten, 30% copper and 15% lead. It has been found, however, the even greater penetration depths beyond that of the tungsten-copper-lead mixture are desirable.

Therefore a need has arisen for a shaped charge that yields improved penetration depths when used for perforating a wellbore. A need has also arisen for such a shaped charge having a liner that utilizes a high performance powdered metal mixture to achieve improved penetration depths.

SUMMARY OF THE INVENTION

The present invention disclosed herein comprises a liner for a shaped charge that utilizes a high performance powdered metal mixture to achieve improved penetration depths during the perforation of a wellbore. The high performance powdered metal mixture includes powdered tungsten and powdered metal binder. The powdered metal binder may be selected from the group consisting of tantalum, molybdenum, lead, copper and combination thereof. This mixture is compressively formed into a substantially conically shaped liner. The mixture may additionally include graphite intermixed with the powdered tungsten and powdered metal binder to act as a lubricant. Alternatively or in addition to the graphite, an oil may intermixed with the powdered tungsten and powdered metal binder to decrease oxidation of the powdered metal.

Tantalum and molybdenum are the preferred components of the binder as optimal performance of a shaped charge comes from the use of powdered metals that have not only a high density, but also, a high sound speed. The product of these two properties is called the acoustic impedance of the material. It has been determined that it is the acoustic impedance of the powdered metal in the shaped charge liner that best determines penetration depth, a higher value being more desirable. Thus, rather than simply increasing the density of the powdered metal mixture, it is more important to increase to acoustic density of the mixture to achieved better shaped charge performance.

In one aspect, the present invention is directed to a liner for a shaped charge that is compressively formed into a substantially conically shaped rigid body from a mixture of approximately 92 to 99 percent by weight of powdered tungsten and approximately 8 to 1 percent by weight of powdered metal binder. In one embodiment, the powdered metal binder consists essentially of lead and molybdenum. In another embodiment, the powdered metal binder consists essentially of lead, molybdenum and tantalum. In a further embodiment, the powdered metal binder consists essentially of lead, molybdenum and copper. In yet another embodiment, the powdered metal binder consists essentially of lead, molybdenum, tantalum and copper.

In another aspect, the present invention is directed to a shaped charge including a housing, a quantity of high explosive inserted into said housing and a liner inserted into the housing so that the high explosive is positioned between the liner and the housing. The liner is compressively formed into a substantially conically shaped rigid body from a mixture of approximately 92 to 99 percent by weight of powdered tungsten and approximately 8 to 1 percent by weight of powdered metal binder. In one embodiment, the powdered metal binder consists essentially of lead and molybdenum. In another embodiment, the powdered metal binder consists essentially of lead, molybdenum and tantalum. In a further embodiment, the powdered metal binder consists essentially of lead, molybdenum and copper. In yet another embodiment, the powdered metal binder consists essentially of lead, molybdenum, tantalum and copper.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

Figure 1:
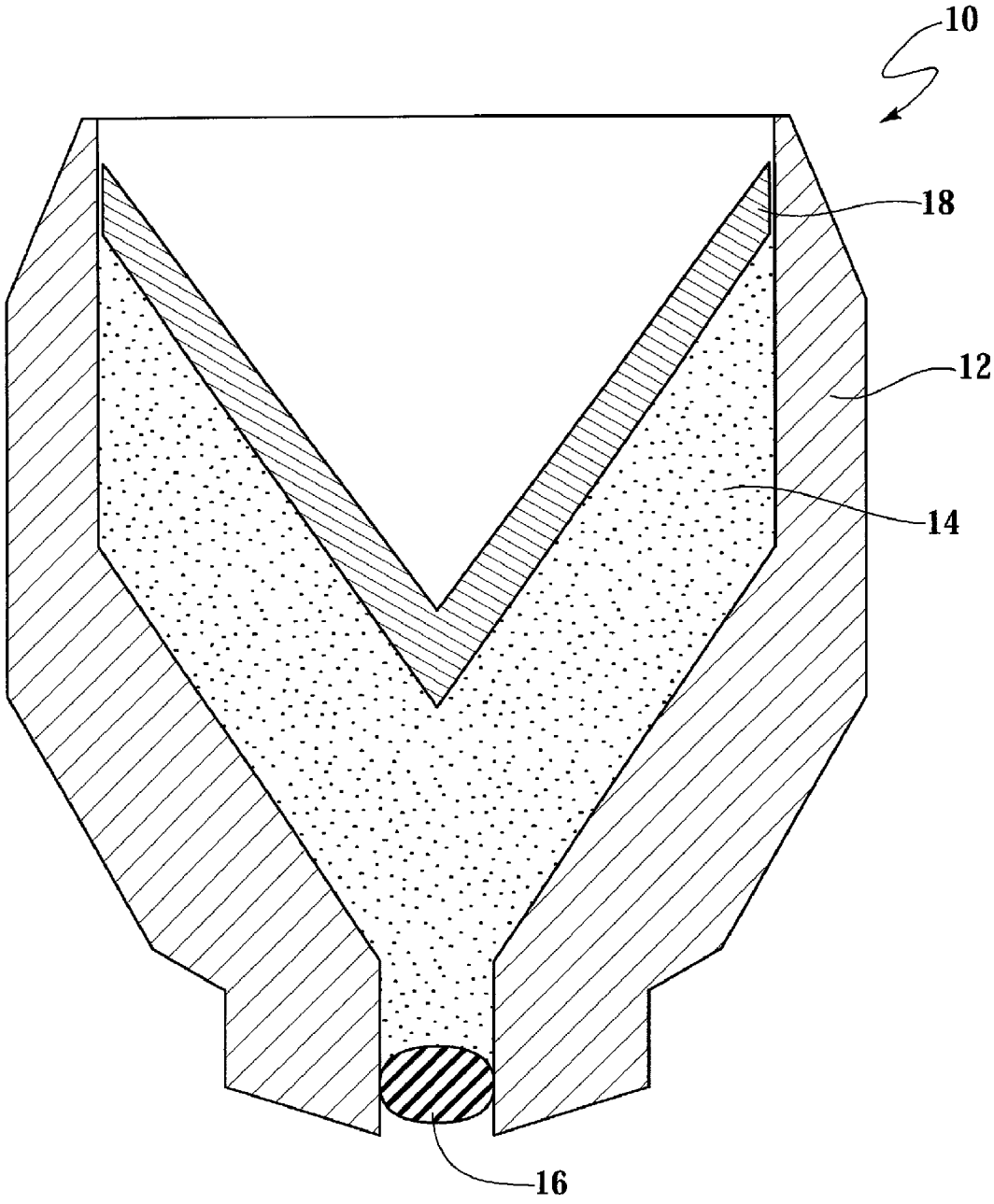
FIG. 1 is a schematic illustration of a shaped charge having a liner according to the present invention.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Referring to FIG. 1, a shaped charge according to the present invention is depicted and generally designated 10. Shaped charge 10 has a generally cylindrically shaped housing 12. Housing 12 may be formed from steel or other suitable material. A quantity of high explosive powder 14 is disposed within housing 12. High explosive powder 14 may be selected from many that are known in the art for use in shaped charges such as the following which are sold under trade designations HMX, HNS, RDX, HNIW and TNAZ. In the illustrated embodiment, high explosive powder 14 is detonated using a detonating signal provided by a detonating cord 16. A booster explosive (not shown) may be used between detonating cord 16 and high explosive powder 14 to efficiently transfer the detonating signal from detonating cord 16 to high explosive powder 14.

A liner 18 is also disposed within housing 12 such that high explosive 14 substantially fills the volume between housing 12 and liner 18. Liner 18 of the present invention is formed by pressing, under very high pressure, powdered metal mixture. Following the pressing process, liner 18 becomes a generally conically shaped rigid body that behaves substantially as a solid mass.

In operation, when high explosive powder 14 is detonated using detonating cord 16, the force of the detonation collapses liner 18 causing liner 18 to be ejected from housing 12 in the form of a jet traveling at very high velocity toward, for example, a well casing. The jet penetrates the well casing, the cement and the formation, thereby forming a perforation.

The production rate of fluids through such perforations is determined by the diameter of the perforations and the penetration depth of the perforations. The production rate increases as either the diameter or the penetration depth of the perforations increase. The penetration depth of the perforations is dependent upon, among other things, the material properties of liner 18. Based upon the test data presented below, it has been determined that penetration depth is not only dependent upon the density of the powdered metal mixture of liner 18 but also upon the sound speed the powdered metal mixture of liner 18. More particularly, it is the acoustic impedance, which is the product of the density and the sound speed, of the powdered metal mixture which determines the penetration depth of perforations created using liner 18. Thus, to maximize the penetration depth, the acoustic impedance of liner 18 should be maximized.

TABLE 1

| Element | Density (g/cc) | Sound Speed (km/sec) | Acoustic Impedance |
|---|---|---|---|
| Tungsten | 19.22 | 4.03 | 77.45 |
| Copper | 8.93 | 3.94 | 35.18 |
| Lead | 11.35 | 2.05 | 23.27 |
| Tin | 7.29 | 2.61 | 19.03 |
| Tantalum | 16.65 | 3.41 | 56.78 |
| Molybdenum | 10.21 | 5.12 | 52.28 |

Table 1 lists the density, the sound speed and the acoustic impedance of several metals which may be used in the fabrication of liner 18 of the present invention. In theory, liner 18 could be made from 100% tungsten as this would yield the highest acoustic impedance for the powdered metal mixture of liner 18. Manufacturing difficulties, however, prevent this from being practical. Because tungsten particles are so hard they do not readily deform, particle-against-particle, to produce a liner with structural integrity. In other words, a liner made from 100% tungsten crumbles easily and is too fragile for use in shaped charge 10. Attempts have been made to strengthen such liners by adding a malleable material such as lead or tin as a binder. As can be seen from table 1, these materials have both low densities and low sound speeds resulting in low acoustic impedances compared to tungsten. Thus, the resulting penetration depth of a liner made from a combination of tungsten and either a lead or tin binder is not optimum.

Liner 18 of the present invention replaces some or all of the lead or tin with one or more high performance materials which is defined herein as a material having an acoustic impedance greater than that of copper. These high performance materials typically have both a high density and a high sound speed, thereby resulting in a high acoustic impedance, and also have suitable malleability in order to give strength to liner 18.

The powdered metal mixture of liner 18 of the present invention comprises a mixture of powdered tungsten and one or more powdered high performance materials. For example, the powdered metal mixture of liner 18 of the present invention may comprises a tungsten-tantalum mixture, a tungsten-molybdenum mixture, a tungsten-tantalum-molybdenum mixture, a tungsten-tantalum-lead mixture, a tungsten-molybdenum-lead mixture, a tungsten-tantalum-molybdenum-lead mixture, a tungsten-tantalum-copper mixture, a tungsten-molybdenum-copper mixture, a tungsten-tantalum-molybdenum-copper mixture, a tungsten-tantalum-lead-copper mixture, a tungsten-molybdenum-lead-copper mixture or a tungsten-tantalum-molybdenum-lead-copper mixture. In each of the above mixtures, the tungsten is typically in the range of approximately 50 to 99 percent by weight. The tantalum is typically in the range of approximately 1 to 30 percent by weight. The molybdenum is typically in the range of approximately 1 to 30 percent by weight. The copper is typically in the range of approximately 1 to 30 percent by weight. The lead is typically in the range of approximately 0 to 20 percent by weight. The powdered metal mixture of liner 18 may additionally include graphite to act as a lubricant. Alternatively or in addition to the graphite, an oil may be mixed into the powdered metal mixture to decrease oxidation of the powdered metal. Using the mixtures of the present invention for liner 18, the penetration depth of shaped charge 10 is improved, compared with the penetration depths achieved by shaped charges having liners of compositions known in the art.

More specifically, liner 18 of the present invention may contain approximately 50 to 90 percent by weight of tungsten, approximately 0 to 20 percent by weight of the lead, approximately 1 to 30 percent by weight of the tantalum and approximately 1 to 30 percent by weight of the molybdenum. Alternatively, liner 18 of the present invention may contain approximately 50 to 90 percent by weight of tungsten, approximately 0 to 20 percent by weight of the lead, approximately 1 to 30 percent by weight of the tantalum and approximately 1 to 30 percent by weight of the copper. As another alternative, liner 18 of the present invention may contain approximately 50 to 90 percent by weight of tungsten, approximately 0 to 20 percent by weight of the lead, approximately 1 to 30 percent by weight of the molybdenum and approximately 1 to 30 percent by weight of the copper. Liner of the present invention may alternatively contain approximately 50 to 90 percent by weight of tungsten, approximately 0 to 20 percent by weight of the lead and approximately 1 to 30 percent by weight of the tantalum. Likewise, liner 18 of the present invention may contain approximately 50 to 90 percent by weight of tungsten, approximately 0 to 20 percent by weight of the lead and approximately 1 to 30 percent by weight of the molybdenum.

The following results were obtained testing various powdered metal mixtures for liner 18 of shaped charge 10 of the present invention.

TABLE 2

| Mixture (Component Weight %) | Penetration Depth (in.) |
|---|---|
| 55% W—27% Ta—18% Pb | 8.24 |
| 55% W—45% Ta | 6.11 |
| 55% W—20% Cu—15% Pb—10% Ta | 8.72 |
| 55% W—20% Cu—15% Pb—10% Ta | 7.64 |
| 55% W—20% Cu—15% Pb—10% Ta | 7.74 |
| 55% W—10% Cu—10% Pb—20% Ta | 7.09 |

All of the embodiments described above contain tungsten in combination with a high performance material to provide liner 18 with increased penetration depth when the jet is formed following detonation of shaped charge 10. As explained above, use of tungsten alone to form liner 18 would result in a very brittle and unworkable liner. Therefore, tungsten is combined with other materials to give the tungsten based liner the required malleability. The present invention achieves this result without sacrificing the performance shaped charge 10 by combining the powdered tungsten with high performance materials such as tantalum and molybdenum. In addition, these mixtures may also contain copper, lead or both.

While this invention has been described with a reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A liner for a shaped charge comprising:

a mixture of powdered tungsten and powdered metal binder including approximately 92 to 99 percent by weight of the tungsten and approximately 8 to 1 percent by weight of the binder, the binder consisting essentially of lead and molybdenum, the mixture compressively formed into a substantially conically shaped rigid body.

2. The liner as recited in claim 1 further comprising a lubricant intermixed with the tungsten and the powdered metal binder.

3. The liner as recited in claim 1 further comprising powdered graphite intermixed with the tungsten and the powdered metal binder.

4. The liner as recited in claim 1 further comprising oil intermixed with the tungsten and the powdered metal binder.

5. A liner for a shaped charge comprising:

a mixture of powdered tungsten and powdered metal binder including approximately 92 to 99 percent by weight of the tungsten and approximately 8 to 1 percent by weight of the binder, the binder consisting essentially of lead, molybdenum and tantalum, the mixture compressively formed into a substantially conically shaped rigid body.

6. The liner as recited in claim 5 further comprising a lubricant intermixed with the tungsten and the powdered metal binder.

7. The liner as recited in claim 5 further comprising powdered graphite intermixed with the tungsten and the powdered metal binder.

8. The liner as recited in claim 5 further comprising oil intermixed with the tungsten and the powdered metal binder.

9. A liner for a shaped charge comprising:

a mixture of powdered tungsten and powdered metal binder including approximately 92 to 99 percent by weight of the tungsten and approximately 8 to 1 percent by weight of the binder, the binder consisting essentially of lead, molybdenum and copper, the mixture compressively formed into a substantially conically shaped rigid body.

10. The liner as recited in claim 9 further comprising a lubricant intermixed with the tungsten and the powdered metal binder.

11. The liner as recited in claim 9 further comprising powdered graphite intermixed with the tungsten and the powdered metal binder.

12. The liner as recited in claim 9 further comprising oil intermixed with the tungsten and the powdered metal binder.

13. A liner for a shaped charge comprising:

a mixture of powdered tungsten and powdered metal binder including approximately 92 to 99 percent by weight of the tungsten and approximately 8 to 1 percent by weight of the binder, the binder consisting essentially of lead, molybdenum, tantalum and copper, the mixture compressively formed into a substantially conically shaped rigid body.

14. The liner as recited in claim 13 further comprising a lubricant intermixed with the tungsten and the powdered metal binder.

15. The liner as recited in claim 13 further comprising powdered graphite intermixed with the tungsten and the powdered metal binder.

16. The liner as recited in claim 13 further comprising oil intermixed with the tungsten and the powdered metal binder.

17. A shaped charge comprising:

a housing;

a quantity of high explosive inserted into said housing; and a liner inserted into said housing so that said high explosive is positioned between said liner and said housing, the liner compressively formed from a mixture of powdered tungsten and powdered metal binder, the mixture including approximately 92 to 99 percent by weight of the tungsten and approximately 8 to 1 percent by weight of the binder, the binder consisting essentially of lead and molybdenum, the mixture compressively formed into a substantially conically shaped rigid body.

18. The shaped charge as recited in claim 17 further comprising a lubricant intermixed with the tungsten and the powdered metal binder.

19. The shaped charge as recited in claim 17 further comprising powdered graphite intermixed with the tungsten and the powdered metal binder.

20. The shaped charge as recited in claim 17 further comprising oil intermixed with the tungsten and the powdered metal binder.

21. A shaped charge comprising:

a housing;

a quantity of high explosive inserted into said housing; and a liner inserted into said housing so that said high explosive is positioned between said liner and said housing, said liner compressively formed from a mixture of powdered tungsten and powdered metal binder, the mixture including approximately 92 to 99 percent by weight of the tungsten and approximately 8 to 1 percent by weight of the binder, the binder consisting essentially of lead, molybdenum and tantalum, the mixture compressively formed into a substantially conically shaped rigid body.

22. The shaped charge as recited in claim 21 further comprising a lubricant intermixed with the tungsten and the powdered metal binder.

23. The shaped charge as recited in claim 21 further comprising powdered graphite intermixed with the tungsten and the powdered metal binder.

24. The shaped charge as recited in claim 21 further comprising oil intermixed with the tungsten and the powdered metal binder.

25. A shaped charge comprising:

a housing;

a quantity of high explosive inserted into said housing; and a liner inserted into said housing so that said high explosive is positioned between said liner and said housing, said liner compressively formed from a mixture of powdered tungsten and powdered metal binder, the mixture including approximately 92 to 99 percent by weight of the tungsten and approximately 8 to 1 percent by weight of the binder, the binder consisting essentially of lead, molybdenum and copper, the mixture compressively formed into a substantially conically shaped rigid body.

26. The shaped charge as recited in claim 25 further comprising a lubricant intermixed with the tungsten and the powdered metal binder.

27. The shaped charge as recited in claim 25 further comprising powdered graphite intermixed with the tungsten and the powdered metal binder.

28. The shaped charge as recited in claim 25 further comprising oil intermixed with the tungsten and the powdered metal binder.

29. A shaped charge comprising:

a housing;

a quantity of high explosive inserted into said housing; and a liner inserted into said housing so that said high explosive is positioned between said liner and said housing, said liner compressively formed from a mixture of powdered tungsten and powdered metal binder, the mixture including approximately 92 to 99 percent by weight of the tungsten and approximately 8 to 1 percent by weight of the binder, the binder consisting essentially of lead, molybdenum, tantalum and copper, the mixture compressively formed into a substantially conically shaped rigid body.

30. The shaped charge as recited in claim 29 further comprising a lubricant intermixed with the tungsten and the powdered metal binder.

31. The shaped charge as recited in claim 29 further comprising powdered graphite intermixed with the tungsten and the powdered metal binder.

32. The shaped charge as recited in claim 29 further comprising oil intermixed with the tungsten and the powdered metal binder.

* * * * *